US008490895B2

(12) United States Patent
Jaworski et al.

(10) Patent No.: US 8,490,895 B2
(45) Date of Patent: Jul. 23, 2013

(54) SHOWERHEAD FOR EMERGENCY FIXTURE

(75) Inventors: Jeffery S. Jaworski, Sussex, WI (US); Timothy E. Perrin, Hartford, WI (US); Kevin B. Kline, Wauwatosa, WI (US)

(73) Assignee: Bradley Fixtures Corporation, Menomonee Falls, WI (US)

( * ) Notice: Subject to any disclaimer, the term of this patent is extended or adjusted under 35 U.S.C. 154(b) by 0 days.

(21) Appl. No.: 13/310,396

(22) Filed: Dec. 2, 2011

(65) Prior Publication Data

US 2012/0073043 A1 Mar. 29, 2012

Related U.S. Application Data

(63) Continuation-in-part of application No. 12/869,551, filed on Aug. 26, 2010, now Pat. No. 8,113,446, which is a continuation of application No. 12/146,025, filed on Jun. 25, 2008, now Pat. No. 7,806,348.

(51) Int. Cl.
*B05B 1/34* (2006.01)
*B05B 1/18* (2006.01)
*A47K 3/28* (2006.01)

(52) U.S. Cl.
USPC ..... 239/472; 239/209; 239/463; 239/590.5; 4/620; 4/900

(58) Field of Classification Search
USPC ..... 239/200, 208, 209, 461, 463, 468–472, 239/474–483, 486, 491, 590, 590.5; 4/596, 4/604, 605, 612–614, 620, 900
See application file for complete search history.

(56) References Cited

U.S. PATENT DOCUMENTS

| | | | | |
|---|---|---|---|---|
| 1,101,264 | A * | 6/1914 | Eneas | 239/8 |
| 1,239,168 | A * | 9/1917 | Eneas | 239/8 |
| 1,245,569 | A | 11/1917 | Comins | |
| 2,027,954 | A | 1/1936 | Barclay | |

(Continued)

FOREIGN PATENT DOCUMENTS

| | | |
|---|---|---|
| DE | 7112090 | 7/1971 |
| DE | 9418847 | 2/1995 |

(Continued)

OTHER PUBLICATIONS

International Search Report and Written Opinion for International Application No. PCT/US2009/045979, Mailing date of international search report Sep. 29, 2009, 9 pages.

(Continued)

*Primary Examiner* — Darren W Gorman
(74) *Attorney, Agent, or Firm* — Foley & Lardner LLP

(57) ABSTRACT

An apparatus for controlling a flow of fluid in an emergency fixture includes a body; and a control element at least partially located in the body and configured to impart rotation into the fluid flow. The control element includes a first substantially cylindrical member defining a first outlet portion, the first outlet portion configured to guide a first portion of the fluid flow out of the control element as an axial flow; a second substantially cylindrical member coupled to the first member; and a plurality of radially extending members extending between the first member and the second member, each of the plurality of members comprising a deflection surface angled relative to a second portion of flow and configured to cause rotation of the second portion of flow.

15 Claims, 11 Drawing Sheets

U.S. PATENT DOCUMENTS

| | | | | |
|---|---|---|---|---|
| 2,305,210 | A | | 12/1942 | Wahlin |
| 2,428,748 | A | | 10/1947 | Barz |
| 2,658,799 | A | | 11/1953 | Fraser |
| 2,751,252 | A | | 6/1956 | Wahlin et al. |
| 2,948,477 | A | | 8/1960 | Fraser |
| 2,949,242 | A | | 8/1960 | Blumberg et al. |
| D189,117 | S | | 10/1960 | Kohler |
| 3,072,346 | A | | 1/1963 | Wahlin et al. |
| 3,146,674 | A | | 9/1964 | Wahlin |
| 3,563,469 | A | | 2/1971 | Stacey et al. |
| 3,865,310 | A | | 2/1975 | Elkins et al. |
| 4,055,301 | A | | 10/1977 | Hruby, Jr. |
| 4,274,595 | A | | 6/1981 | Yamin |
| 4,598,866 | A | | 7/1986 | Cammack et al. |
| 4,768,717 | A | | 9/1988 | Shay |
| 5,008,963 | A | | 4/1991 | Stein |
| 5,232,165 | A | * | 8/1993 | Tournier ..... 239/462 |
| 5,530,972 | A | | 7/1996 | Tanner |
| 5,862,985 | A | | 1/1999 | Neibrook et al. |
| 6,205,599 | B1 | | 3/2001 | Anders |
| 6,254,013 | B1 | | 7/2001 | Clearman et al. |
| 6,923,386 | B2 | | 8/2005 | Bonzer |
| D604,801 | S | | 11/2009 | Zore |
| 7,806,348 | B2 | | 10/2010 | Kline et al. |
| 2006/0102750 | A1 | | 5/2006 | Grether |
| 2007/0204398 | A1 | | 9/2007 | Dubois |
| 2009/0288251 | A1 | | 11/2009 | Strandberg et al. |

FOREIGN PATENT DOCUMENTS

| | | |
|---|---|---|
| FR | 1063462 | 5/1954 |
| KR | 10-0199182 | 6/1999 |
| KR | 20-0322207 | 2/2003 |

OTHER PUBLICATIONS

Haws Corporation, Introducing the Revolutionary New axion™ msr, 2008, 6 pages.

English translation of German Utility Model Registration No. G 94 18 847.5 to Zvonko, Zdejlar, 17 pages, Feb. 16, 1995.

International Search Report for International Application No. PCT/US2009/045979, mail date Sep. 29, 2009, 2 pages.

Haws Corporation, Specifying Emergency Drench Showers & Eyewashes, Dec. 10, 2008, 30 pages.

Whirl, WL Low Flow/Full Cone, www.BETE.com, available at least by Jun. 25, 2008, 3 pages.

International Search Report and Written Opinion regarding International Application No. PCT/US2012/066946, mail date Mar. 18, 2013, 7 pages.

* cited by examiner

SHOWERHEAD FOR EMERGENCY FIXTURE

CROSS-REFERENCE TO RELATED APPLICATION

This application is a continuation-in-part of U.S. application Ser. No. 12/869,551, filed Aug. 26, 2010, which is a continuation of U.S. application Ser. No. 12/146,025, filed Jun. 25, 2008, now U.S. Pat. No. 7,806,348, issued Oct. 5, 2010, both of which are incorporated herein by reference in their entireties.

BACKGROUND

The present invention relates to a showerhead for emergency fixture.

It is generally known to provide a showerhead for an emergency fixture. Such a showerhead is typically configured to release a spray of water to soak a user in an emergency situation (e.g., to extinguish a fire, to rinse off a dangerous substance, etc.).

It would be advantageous to provide a showerhead for emergency fixture. It would also be advantageous to provide a showerhead that creates a more uniform spray pattern. It would also be advantageous to provide a showerhead that provides a more uniform spray pattern from a single outlet to reduce the chance of blockage from dirt or other deposits in the water. It would be desirable to provide for a showerhead for emergency fixture having one or more of these or other advantageous features. To provide an inexpensive, reliable, and widely adaptable showerhead for emergency fixture that avoids the above-referenced and other problems would represent a significant advance in the art

SUMMARY

One embodiment relates to an apparatus for controlling a flow of fluid in an emergency fixture, the apparatus comprising a body; a control element at least partially located in the body and configured to impart rotation into the fluid flow, the control element comprising a first substantially cylindrical member defining a first outlet portion, the first outlet portion configured to guide a first portion of the fluid flow out of the control element as an axial flow; a second substantially cylindrical member coupled to the first member; and a plurality of radially extending members extending between the first member and the second member, each of the plurality of members comprising a deflection surface angled relative to a second portion of flow and configured to cause rotation of the second portion of flow.

Another embodiment relates to an apparatus for controlling a flow of fluid in an emergency fixture, the apparatus comprising a body; a control element disposed at least partially within the body; the control element comprising a first body configured to provide an axial flow to a first portion of fluid; and a second body coupled to the first body via a plurality of flow guide elements, each flow guide element extending along an exterior surface of the first body in a substantially helical fashion and configured to impart a rotation to a second portion of fluid.

Another embodiment relates to an apparatus for controlling a flow of fluid, the apparatus comprising a body; a control element located at least partially within the body and configured to impart a rotation to the flow of fluid, the control element comprising an upper member; and a lower member coupled to the upper member via a plurality of flow control elements, each flow control element comprising a curved deflection surface; wherein the lower member is configured to receive a first portion of the fluid from the upper member and direct the first portion of the fluid out a first outlet in an axial flow manner; and wherein the plurality of flow control elements are configured to receive a second portion of the fluid from the upper member via a second outlet and impart a rotation to the second portion of the fluid as the second portion of the fluid flows between the lower member and the body.

Another embodiment relates to a fixture for delivering a flow of fluid, the fixture comprising a valve; a shower head coupled to the valve and comprising a body and a flow control element, the flow control element comprising: an upper generally tubular member; a lower tapered member provided downstream from the upper member and coupled to the upper member via a plurality of flow directing elements; each flow directing element comprising an upper portion extending between the upper member and the lower member; and an elongated lower portion extending from the upper portion and along the outside surface of the lower member, the elongated lower portion having at least one curved surface.

Another embodiment of the invention relates to an apparatus for controlling a flow of fluid in an emergency fixture. The apparatus comprises a first control element at least partially located in the body and configured to impart rotation into the fluid flow. The first control element comprises an inlet that receives fluid, and an outlet that divides the fluid flow into at least a first portion and a second portion. The outlet comprises a first outlet portion and a second outlet portion. The first outlet portion guides the first portion of the flow out of the first control element as an axial flow. The second outlet portion provides rotation to the second portion of the flow relative to the axial flow.

The present invention also relates to a method of controlling a flow of fluid in an emergency fixture. The method comprises providing a showerhead having a first control element; providing a fluid flow to the inlet of the showerhead; flowing the fluid flow into the first flow control element and separating the fluid flow into a first flow portion and a second flow portion; flowing the first flow portion through a first outlet on a path coaxial with an axis of the first control element; and flowing the second flow portion through a second outlet on a path rotating relative to the axis of the first control element.

The present invention further relates to an emergency fixture configured to deliver a fluid. The emergency fixture comprises a valve; a showerhead coupled to the valve and having a body, a flow volume control element and a flow rotation control element. The flow volume control element is configured to control the volume of the fluid flow. The flow rotation control element is located downstream from the flow volume control element and is configured to impart rotation into the fluid flow. The flow rotation control element comprises an inlet that receives fluid from the flow volume control element and an outlet. The outlet comprises a first outlet portion defining a bore for a first portion of the fluid flow, and a second outlet portion defining an annular opening circumscribing the bore of the first outlet portion and for a second portion of the fluid flow. At least one member extends across the annular opening and has a deflection surface angled relative to the direction of the first portion of the flow so that liquid deflects off the deflection surface during use. The first outlet portion guides the first portion of the flow out of the flow rotation control element as an axial flow, and wherein the second outlet portion provides rotation to the second portion of the flow relative to the axial flow.

The present invention further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the claims which follow.

Figure 1:
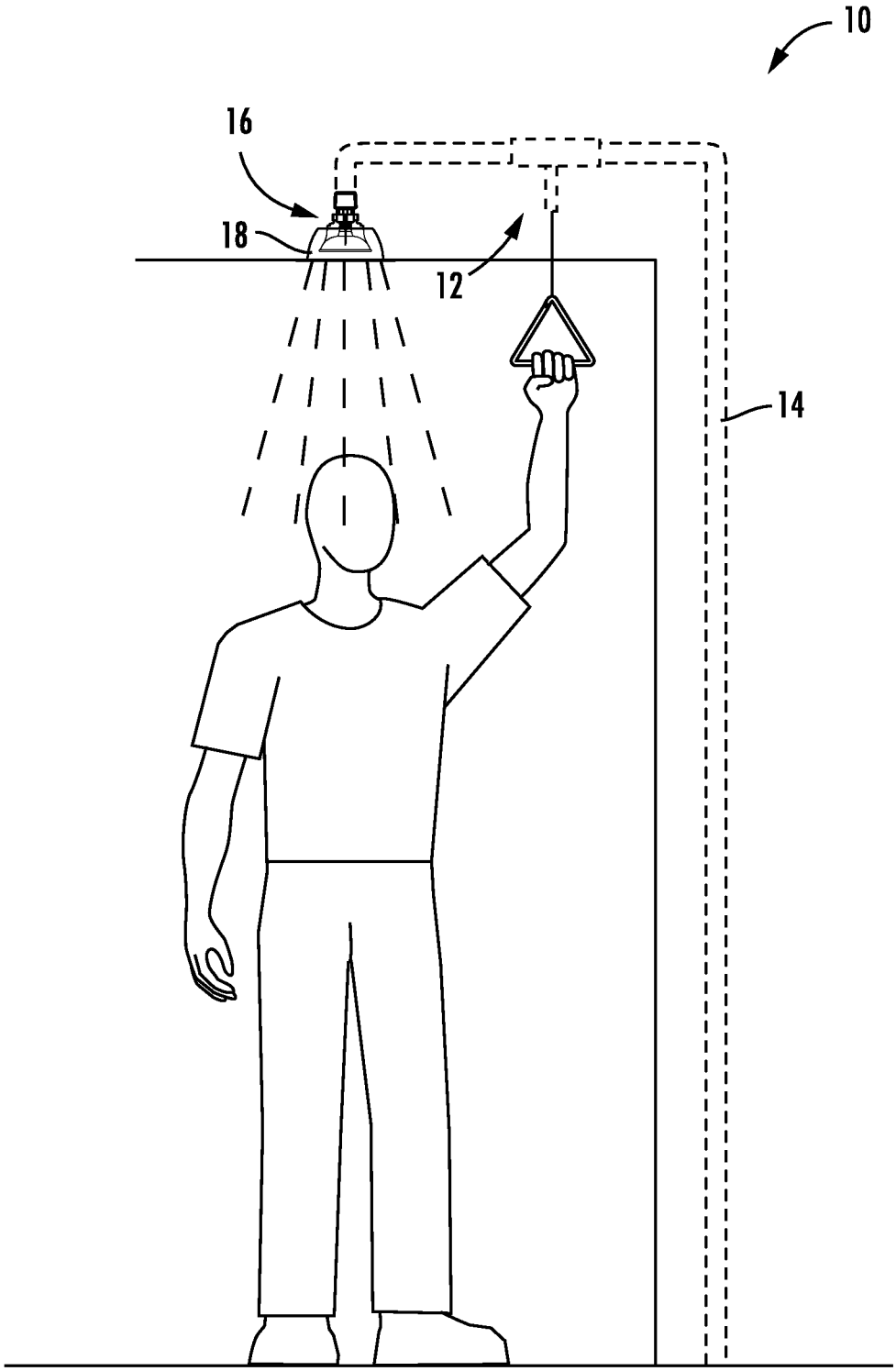
FIG. 1 is a side view of an emergency fixture (shower) including a showerhead assembly according to an exemplary embodiment mounted flush to the ceiling.

Before explaining a number of preferred, exemplary, and alternative embodiments of the invention in detail it is to be understood that the invention is not limited to the details of construction and the arrangement of the components set forth in the following description or illustrated in the drawings. The invention is capable of other embodiments or being practiced or carried out in various ways. It is also to be understood that the phraseology and terminology employed herein is for the purpose of description and should not be regarded as limiting.

DETAILED DESCRIPTION OF EXEMPLARY EMBODIMENTS

Before proceeding to the detailed description of the preferred and exemplary embodiments, several comments can be made about the general applicability and the scope thereof.

First, while the components of the disclosed embodiments will be illustrated as a showerhead designed for an emergency shower fixture, the features of the disclosed embodiments have a much wider applicability. For example, the showerhead design is adaptable for other applications requiring a desired spray pattern/quantity of water, such as residential, commercial, and industrial installations.

Second, the particular materials used to construct the exemplary embodiments are also illustrative. For example, injection molded acrylonitrile butadiene styrene ("ABS") are an exemplary method and material for making the nozzle and spinner, and injection molded acetal plastic are an exemplary method and material for making the flow control (with the o-ring being EPDM rubber), but other materials can be used, including other thermoplastic resins such as polypropylene, high density polyethylene, other polyethylenes, polyurethane, nylon, any of a variety of homopolymer plastics, copolymer plastics, plastics with special additives, filled plastics, etc. Also, other molding operations may be used to form these components, such as blow molding, rotational molding, etc. Components of the showerhead can also be manufactured from cast or forged metal including but not limited to stainless steel or aluminum.

Figure 12:
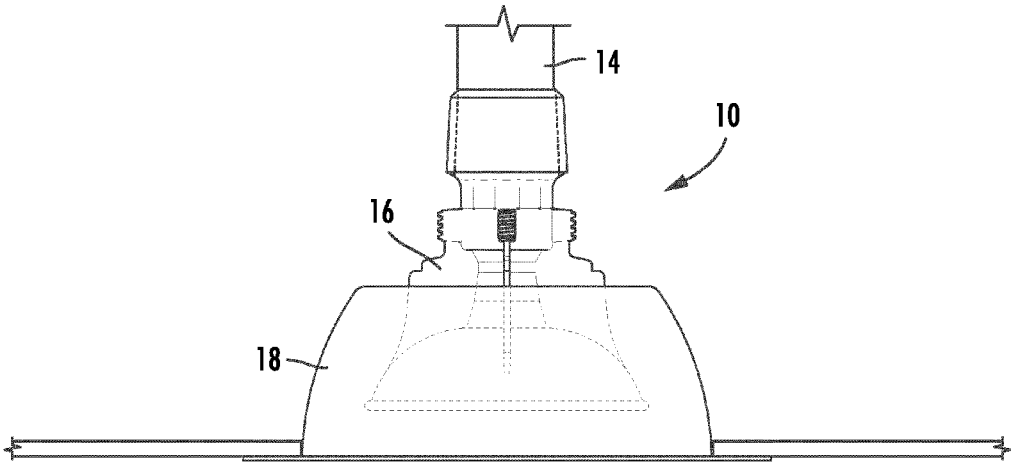
FIG. 12 is a side view of the showerhead assembly of FIG. 2 mounted according to one exemplary embodiment.
Figure 13:
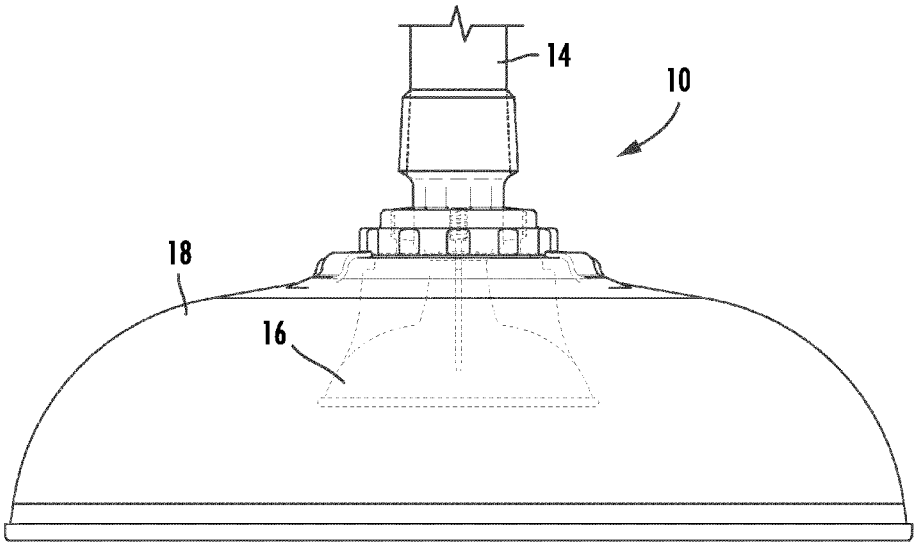
FIG. 13 is a side view of the showerhead assembly of FIG. 2 mounted according to another exemplary embodiment.
Figure 14:
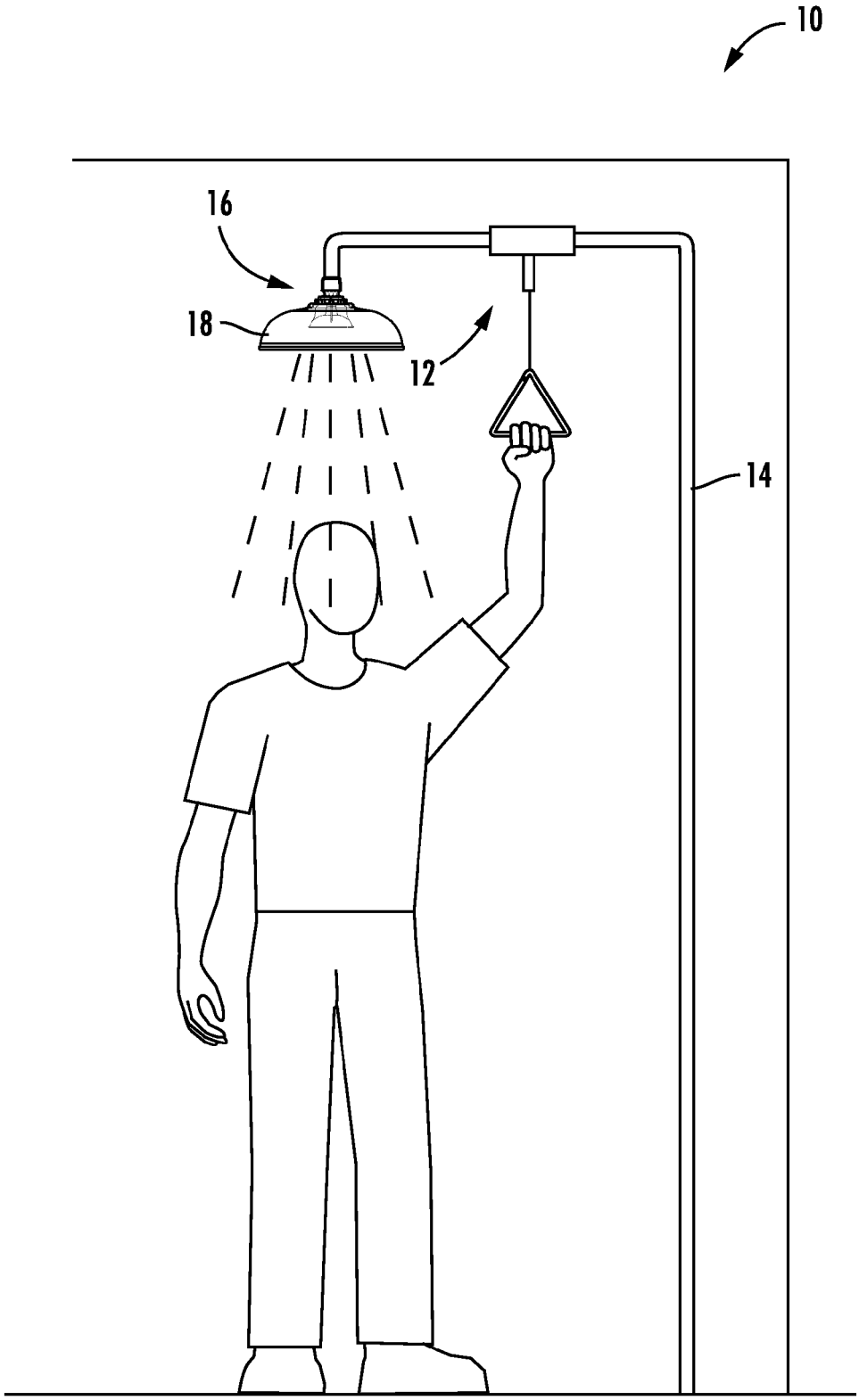
FIG. 14 is a side view of a free-standing emergency fixture (shower) including a showerhead assembly according to an exemplary embodiment.

Referring to FIG. 1, an emergency fixture 10 is shown as an emergency shower according to an exemplary embodiment. Such fixtures 10 are often provided in laboratories or other environments where hazardous conditions due to fire or chemicals may be present. In such environments, where the eyes or body of any person may be exposed to corrosive or otherwise hazardous materials, emergency fixtures 10 provide quick drenching or flushing of the body. Emergency fixtures 10 may include an eyewash station (not shown) to flush the eyes of a user and/or an overhead showerhead 16 that drenches the body of a user. Emergency fixtures 10 are generally controlled by a valve 12 activated by a mechanism (shown as a pull cord in FIG. 1, but may be a lever, button, or the like), that allows water or another substance flow through plumbing 14 to emerge from the eyewash station and/or showerhead 16. According to various exemplary embodiments, the plumbing 14 for emergency fixture 10 may be wholly exposed, partially exposed, or may be concealed within the walls and ceiling. For example as shown in FIGS. 1 and 12, the showerhead 16 may be recessed into the ceiling and a shroud and trim plate or other trim piece 18 may be mounted to trim out the hole. According to another exemplary embodiment, as shown in FIGS. 13 and 14, the showerhead 16 may be mounted below the ceiling (e.g., on a free-standing unit) and the trim piece 18 may be a bowl coupled to the showerhead 16.

Figure 2:
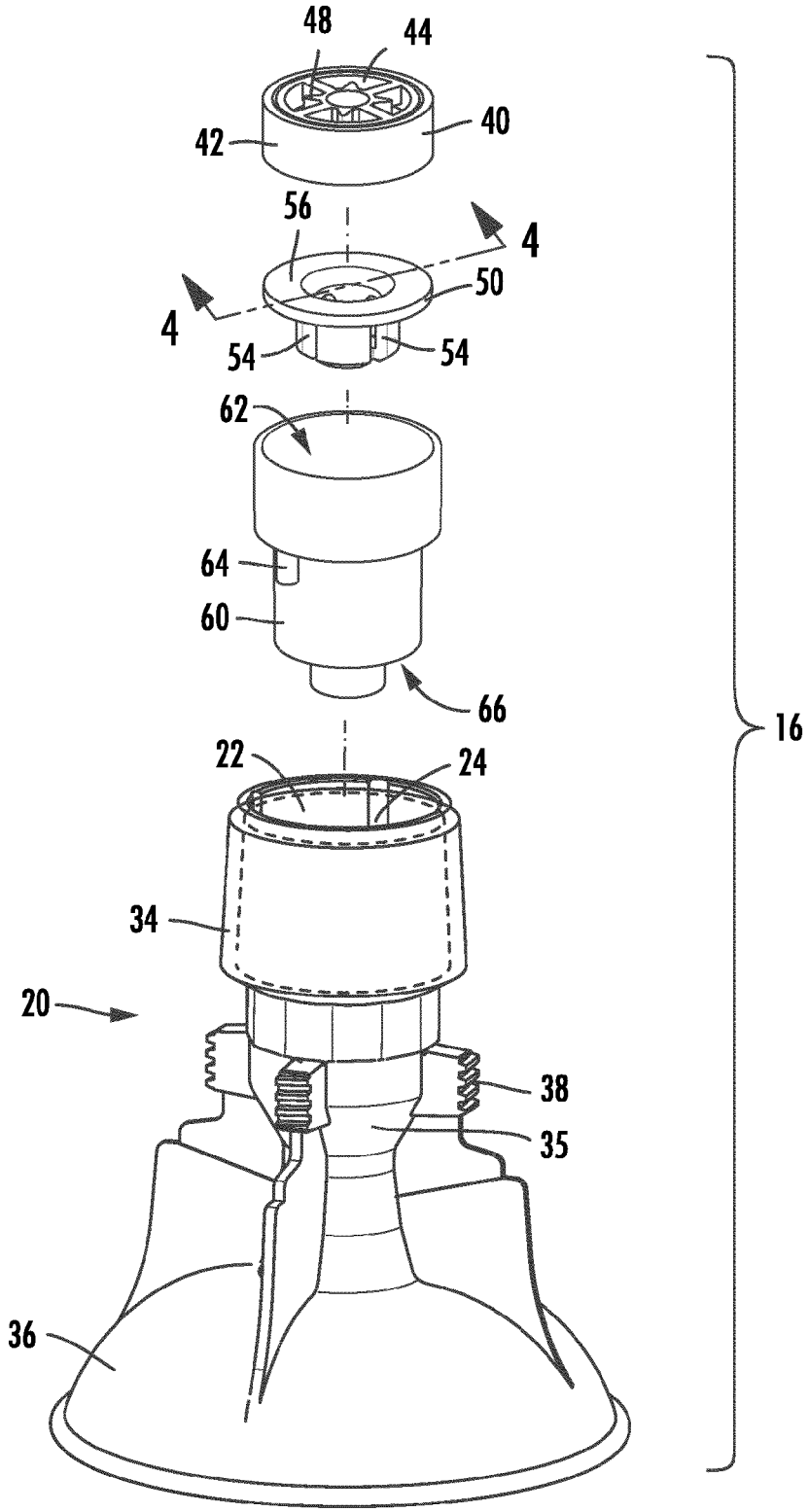
FIG. 2 is an exploded view of a showerhead assembly according to an exemplary embodiment.

Referring now to FIG. 2, a showerhead assembly 16 is shown that provides a more uniform spray pattern, and is intended to meet both United States (e.g., local, state and/or federal) and new European specifications and provide an improved washdown through a single outlet. Showerhead assembly 16 includes a main housing or body 20, a flow volume control element 40, a diverter 50, and a flow rotation control element 60. Flow volume control elements 40 and diverter 50 are held within flow rotation control member or element 60 which is, in turn, held within main body 20. Flow volume control element 40, diverter 50, and flow rotation control element 60 alter the flow of water supplied to showerhead assembly 16.

Figure 10:
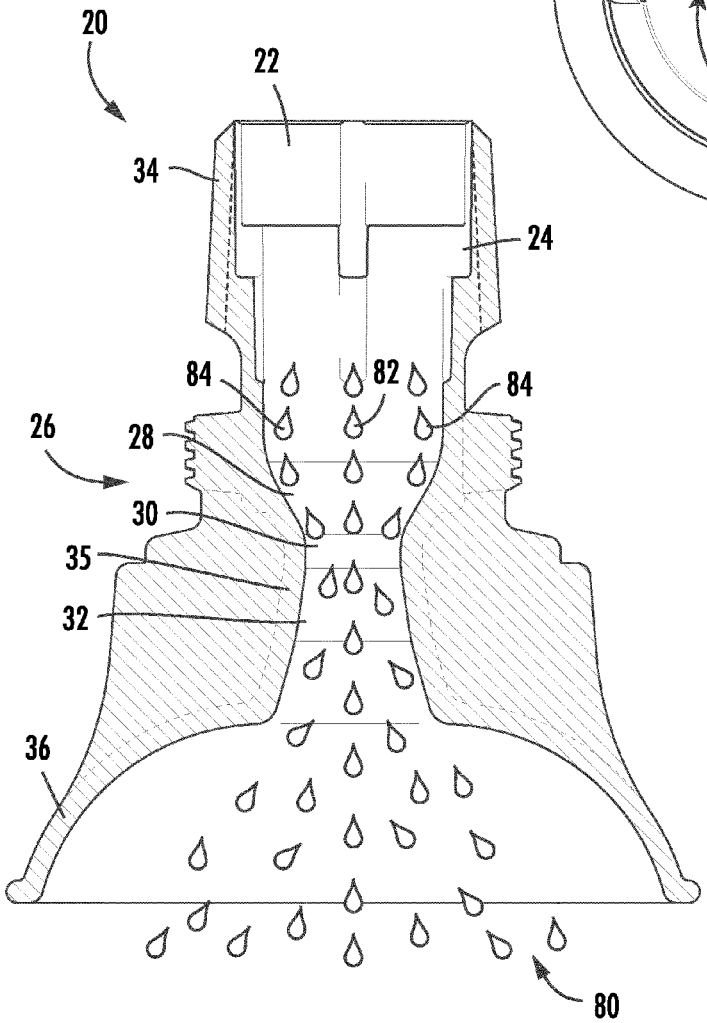
FIG. 10 is a cross section of a portion of the main body of the showerhead assembly of FIG. 2 schematically showing the fluid flow through the nozzle according to an exemplary embodiment.

Referring to FIGS. 2 and 10, main body or housing 20 includes a head portion 34, a neck portion 35 and a bell portion 36. Head portion 34 may include threads to couple showerhead assembly 16 to plumbing 14 (e.g. with a threaded coupling). A trim piece (shown in FIG. 13) may be provided that is coupled to main body 20 with additional threaded protrusions 38. Main body 20 includes a bore 22 that extends from head portion 34, through neck portion 35 to bell portion 36. Bore 22 has a first portion that receives the flow rotation control element 60 and a second portion, downstream from the first portion, that forms a nozzle 26 (shown best in FIG. 10).

Figure 9:
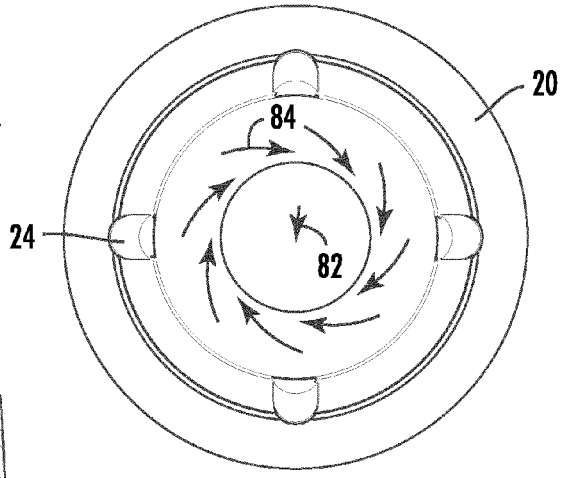
FIG. 9 is a top view of the main body of the showerhead assembly of FIG. 2 schematically showing the first and second fluid paths through the inlet and throat portions of the nozzle formed by the main body.

Referring to FIGS. 2, 9, and 10, longitudinal recesses or grooves 24 are formed in the first portion of bore 22. According to an exemplary embodiment, four grooves 24 are formed in bore 22 spaced evenly around bore 22. At least one of grooves 24 receives a projection 64 on flow rotation control element 60 to inhibit the rotation of flow rotation control element 60 relative to main body 20 during operation of showerhead assembly 16, as will be described in more detail below. Grooves 24 further provide drainage notches to facilitate the passage of air and/or water through bore 22 between flow rotation control element 60 and main body 20. Sufficient drainage is desirable to reduce stagnant water pooling within showerhead assembly 16 which may provide conditions for the growth of mold, bacteria, or other undesirable organisms.

Figure 3:
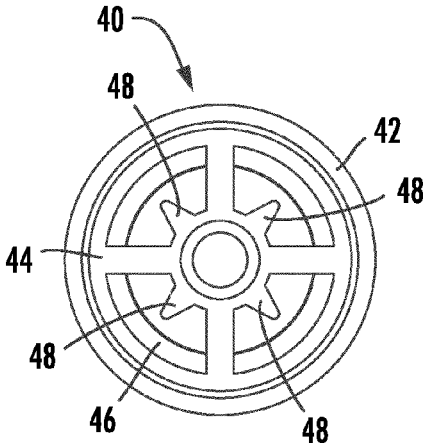
FIG. 3 is a top plan view of a flow regulator for the showerhead assembly of FIG. 2 according to one exemplary embodiment.

Referring now to FIG. 3, flow volume control element 40 is shown according to one exemplary embodiment. Flow volume control element 40 is a flow regulator configured to maintain a generally constant flow rate at a range of pressures. One exemplary flow regulator is an L-Type flow regulator, model number 58.6668.1 commercially available from NEOPERL Inc of Waterbury, Conn. Flow volume control element 40 includes an outer member 42 with a central opening and an inner member 44 that nests within outer member 42. A resilient member, such as o-ring 46, is trapped between the end walls of inner member 44 and outer member 42 on the downstream side of flow volume control element 40. As the pressure difference across flow volume control element 40 increases (e.g., between the upstream and downstream sides) the o-ring 46 is forced into the central opening of flow volume control element 40, thereby reducing (i.e., controlling) the flow rate of liquid through flow volume control element 40. As the pressure difference is reduced, o-ring 46 retracts from the central opening and forces inner member 44 upstream. Flow 80 (FIG. 10) through flow volume control element 40 is further obstructed by spokes 48 on inner member 44. The size and/or number of spokes 48 on a control member 40 may be decreased or increased to increase or decrease the flow through the control member 40. According to a preferred embodiment, flow volume control element 40 limits the flow rate to between approximately 17 and 24 gallons per minute (gpm). For example, at a low pressure such as 20 psi, flow volume control element may limit the flow to 17 gpm. At a higher pressure such as 50 psi, flow volume control element may limit the flow to 24 gpm.

According to other exemplary embodiments, flow volume control element 40 is not housed within main body 20 and may be provided further upstream from showerhead assembly 16. According to other exemplary embodiments, flow volume control element 40 may be a different volume control element such as a valve.

Figure 6:
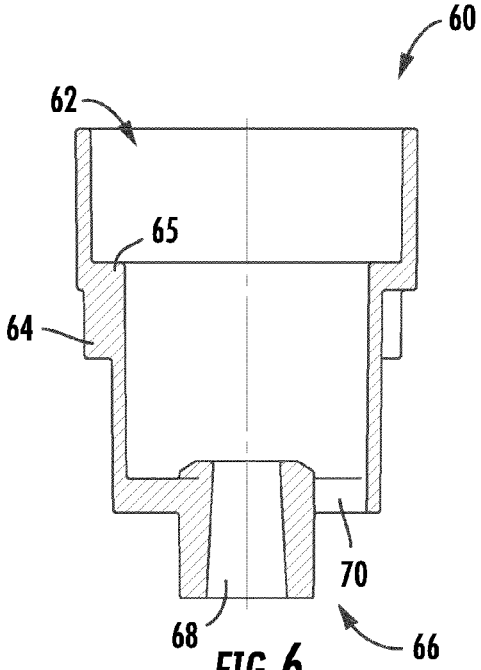
FIG. 6 is a cross section of the flow rotation control element of FIG. 5 taken along line 6-6.
Figure 4:
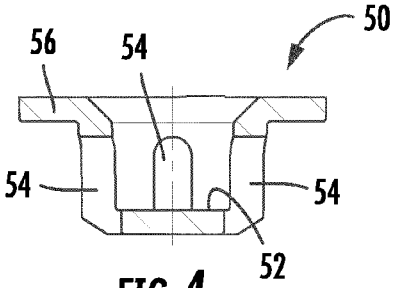
FIG. 4 is a cross section of a flow diverter of FIG. 2 according to an exemplary embodiment taken along line 4-4.

After passing through flow volume control element 40, the water passes through diverter 50. Diverter 50 is configured to redirect the flow 80. Referring now to FIG. 4, diverter 50 is a cup-shaped member with an end wall 52, one or more side openings 54, and a flange 56. Diverter 50 is housed within second control element 60 with flange 56 resting on an interior shoulder or ledge 65 of second control element 60, as shown in FIG. 6. Water flowing through diverter 50 hits end wall 52 and is redirected through side openings 54. According to an exemplary embodiment, four openings 54 are provided spaced equally about the circumference of diverter 50. The flow 80 through diverter 50 is shown schematically in FIG. 8.

Figure 5:
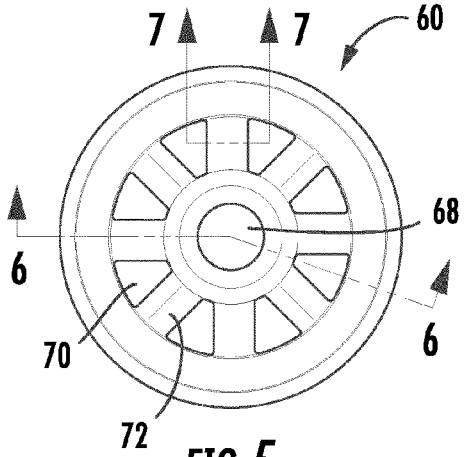
FIG. 5 is a top plan view of a flow rotation control element for the showerhead assembly of FIG. 2 according to an exemplary embodiment.
Figure 7:
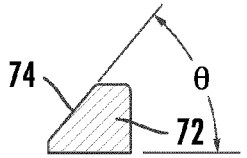
FIG. 7 is a cross section of a portion of the flow rotation control element of FIG. 5 taken along line 7-7—showing an angled deflection surface according to an exemplary embodiment.

Referring now to FIGS. 5-7, second control element (or flow rotation element) 60 is shown according to one exemplary embodiment. Second control element 60 imparts a rotation on at least a portion of the flow passing through showerhead assembly 16. Second control element 60 is a generally tubular member with an inlet 62 that receives flow volume control element 40 and diverter 50, and an outlet 66. According to one exemplary embodiment, two projections 64 protrude outward from opposite sides of second control element 60. Projections 64 are longitudinal elements that are received in grooves 24 formed in bore 22 of main body 20. As second control element 60 imparts a rotation on the flow, an opposite rotational force is in turn applied to second control element 60. With projections 64 seated in grooves 24, second control element 60 is restrained from rotating relative to main body 20. According to other exemplary embodiments, second control element 60 may be restrained from rotating relative to main body 20 with another mechanism. For example, second control element 60 may be restrained with an adhesive, a fastener, or some other suitable mechanism. An inwardly extending shoulder or ledge 65 provides a surface upon which diverter 50 rests, as shown best in FIG. 8.

Outlet 66 of second control element 60 includes a first outlet portion 68 (e.g., port, aperture, orifice, opening, etc.) and a second outlet portion 70 (e.g., port, aperture, orifice, opening, etc.). First outlet portion 68 forms a generally bore (e.g., cylindrical, conical, elliptical, rectangular, etc.) aligned with the longitudinal axis of second control element 60. Second outlet portion 70 defines an annular opening circumscribing first outlet portion 68. One or more radial members 72 extend across second outlet portion 70. Radial members 72 form an angled deflection surface 74, shown best in FIG. 7. Radial members 72 extend between an upper body (e.g., an upper cylindrical member) and a lower body (e.g., a lower cylindrical member) of second control element 60. According to a preferred embodiment, angled deflection surface 74 has an angle θ between 10 degrees and 80 degrees According to a particularly preferred embodiment, angled deflection surface 74 has an angle θ of approximately 40 degrees.

Figure 8:
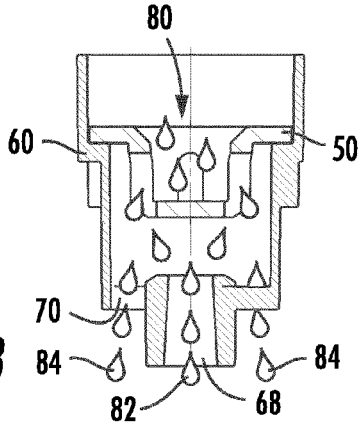
FIG. 8 is a cross section of a portion of the showerhead assembly of FIG. 2 schematically showing the fluid flow through the flow diverter and flow rotation control element according to an exemplary embodiment.

Referring to FIGS. 6, 7 and 8, outlet 66 divides the flow 80 into a first portion 82 and a second portion 84. First flow portion 82 is a generally axial flow, passing through first outlet portion 68 and flowing parallel to the longitudinal axis of second control element 60. Second flow portion 84 passes through second outlet portion 70. Second flow portion 84 is redirected by angled deflection surfaces 74 (shown in FIG. 7) so that it rotates about first flow portion 82, as shown best in FIG. 9.

Referring now to FIG. 10, axial first flow portion 82 and rotating second flow portion 84 pass from second control element 60 into nozzle 26. Nozzle 26 includes an inlet portion 28, a throat, 30, and an outlet portion 32. Inlet portion 28 has an initial cross-section approximately the same size as the cross-section of bore 22 proximate to second control element 60. The cross-section of inlet portion 28 narrows as the downstream distance from second control element 60 increases. Throat 30 provides a minimum cross-section of nozzle 26. The cross-section of outlet portion 32 expands as the downstream distance from throat 30 increases until it opens into bell section 36.

At least a portion of second flow portion 84 flows along the walls of nozzle 26. Proximate to second control element 60, second flow portion 84 comprises a generally stable (e.g., organized, even, predictable, etc.) flow. As second flow portion 84 passes downstream, through throat 30, it becomes an unstable, turbulent flow. The unstable flow causes second flow portion 84 to disperse and diverge as it passes from throat 30 to outlet 32 and out of showerhead assembly 16 to drench a user. First flow portion 82 continues generally along the longitudinal axis of nozzle 26 and forms the inner portion of the spray pattern while second flow portion expands to create the outer portion of the spray pattern.

By using a single large opening (e.g., outlet 32) to expel water from showerhead assembly 16 instead of a larger head with multiple outlets to direct water to specific areas, there is a reduced chance for dirt or other particles in the water to block the outlet and reduce the effectiveness of emergency fixture 10. Further, a single large outlet 32 is effected less than multiple smaller outlets to corrosion build up.

Figure 11:
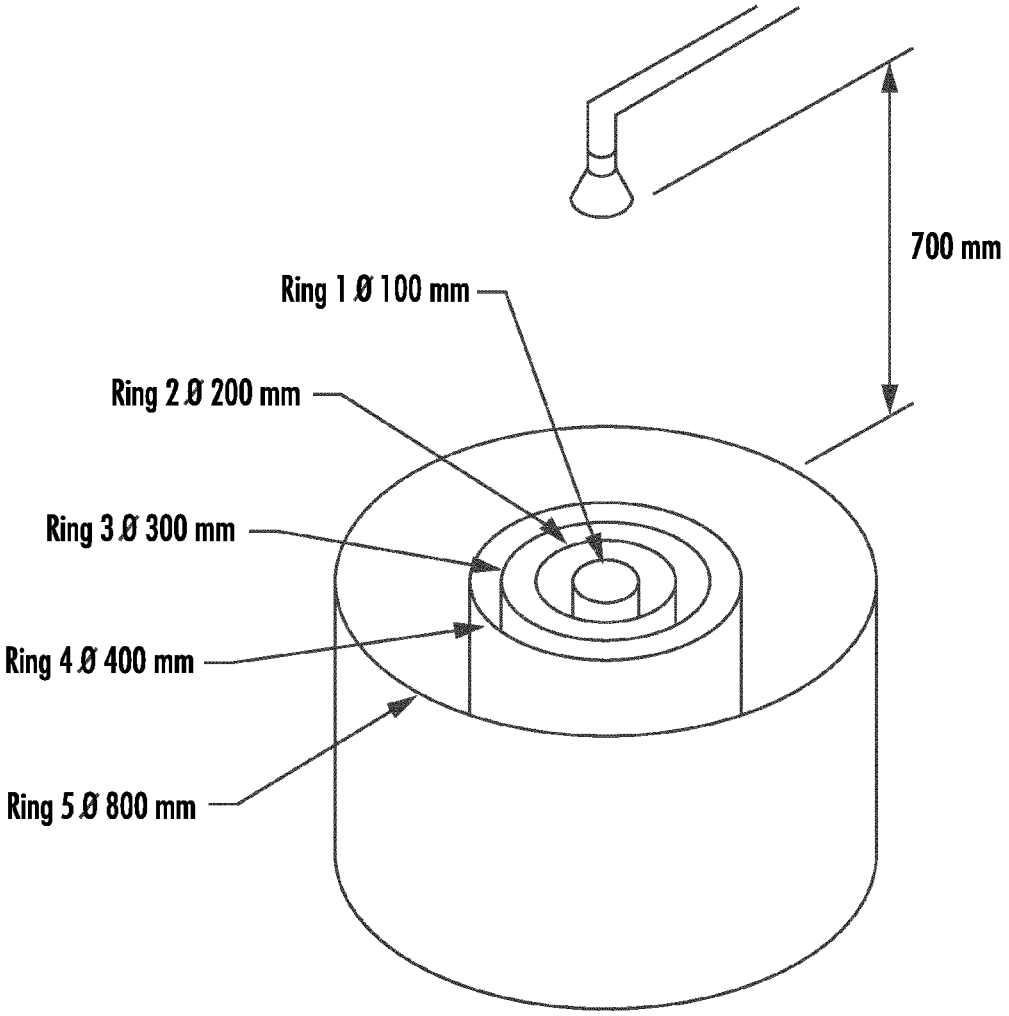
FIG. 11 is an isometric view of an apparatus for testing an emergency fixture.

To assure that the water emerging from showerhead 16 sufficiently covers the body of a user, the spread and pattern of the spray is intended to be carefully controlled. For example, European Standard EN15154-1 requires that plumbed-in body showers pass a test procedure involving water falling onto an apparatus including a series of circles, shown in FIG. 11. At a distance 700 mm below the shower head, 50±10% of the water falls in a circle 400 mm in diameter. Further the water falling within a 100 mm circle and the water falling in annular areas between the 100 mm circle and the 200 mm circle, the 200 mm circle and the 300 mm circle, and the 300 mm circle and the 400 mm circle must each deviate by less than 30% from the mean value. Still further, 95% of the water must fall within a circle 800 mm in diameter.

Referring now to FIGS. 15-26 a showerhead 116 and a flow rotation control element 160 are shown according to various exemplary embodiments. Showerhead 116 may be usable with emergency fixture 10 and/or similar fixtures to provide a desired spray pattern and/or quantity of water for residential, commercial, industrial, or other installations. In some embodiments, showerhead 116 provides a "drench" shower feature without any moving components, such that the flow rate and/or flow pattern are controlled by appropriately sizing the inlet/outlet apertures of the showerhead components and imparting an appropriate rotation, or spin, to at least a portion of the flow.

Generally, a rate of flow may be increased by increasing the area open to flow (e.g., apertures, nozzles, etc.), and decreased by increasing the spin, or rotation, of the flow. Furthermore, increasing the rotation of the flow may enlarge, or widen, the spray pattern of the flow exiting the showerhead, while increasing the flow rate (or pressure) of the flow may reduce, or narrow, the resulting spray pattern. As such, utilizing appropriately sized and shaped components (e.g., inlets, outlets, flow rotation control members, etc.) enables the current showerhead to provide a desired flow rate and/or spray pattern, and to match the flow control characteristics of other conventional showerheads requiring various "active" flow regulators, which often require one or more movable parts. In some embodiments, the largest spray pattern is obtained by using a flow pressure range of approximately 20-25 psig.

As discussed in greater detail below, various embodiments disclosed herein relate to a showerhead that splits a flow of fluid into two separate paths, providing one portion of the flow as straight line flow along the longitudinal axis of the showerhead, and diverting a second portion of flow to an exterior surface of a flow rotation control element that imparts a rotation, or spin, to the second portion of flow. The ratio of straight line flow to rotational flow, along with the shape characteristics of the showerhead components, control both the flow rate and the spray pattern of flow exiting from the showerhead.

Referring now to FIGS. 15-18, showerhead 116 is shown according to an exemplary embodiment. Showerhead 116 includes a main body or housing 120 and a flow rotation control element 160. Control element 160 is held within or by main body 120 and alters the flow of water supplied to shower head 116. As discussed in greater detail below, control element 160 provides a first portion of flow as axial flow, and a second portion of flow as rotational flow.

Main body 120 is generally similar to main body 20, and includes a head portion 134, a neck portion 135, and a bell portion 136. Head portion 134 may include threads to couple showerhead assembly 116 to plumbing such as plumbing 14 shown in FIG. 1 (e.g. with a threaded coupling). A trim piece such as trim piece 18 shown in FIG. 13 may be provided that is coupled to main body 120 with additional threaded protrusions 138. Main body 120 includes a bore 122 that extends from head portion 134, through neck portion 135 to bell portion 136. Bore 122 has a first portion that receives control element 160 and a second portion, downstream from the first portion, that forms a nozzle 126 (shown best in FIG. 18).

Referring now to FIGS. 19-26, flow rotation control element 160 is shown in greater detail according to an exemplary embodiment. Control element 160 imparts a rotation to at least a portion of the flow passing through showerhead 116. Control element 160 includes a first or lower member or body 182 (e.g., a downstream, lower, or first member or body), and a second or upper member or body 180 (e.g., an upstream, upper, or second member or body). A number of flow guide elements 172 (e.g., ribs, fins, projections, elongated members, etc.) extend between and are coupled to upper member 180 and lower member 182. Lower member 182 includes a lower, or first, exit aperture or outlet 168. Upper member 180, lower member 182, and guide elements 172 define a plurality of apertures 170 that collectively form an upper, or second, exit aperture or outlet 169 for control element 160.

Figure 23:
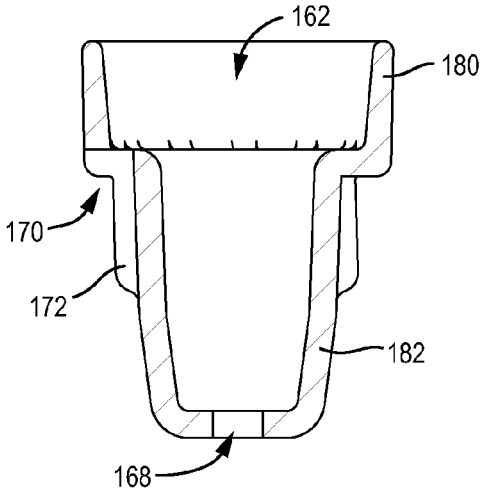
FIG. 23 is a cross-sectional view of the control element of FIG. 19 taken along line 23-23 of FIG. 20 according to an exemplary embodiment.
Figure 21:
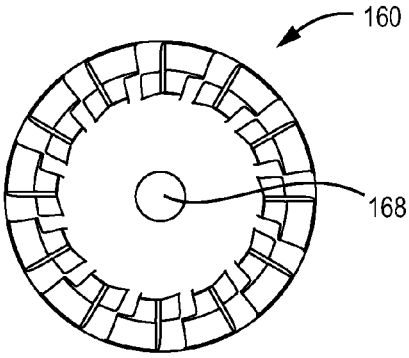
FIG. 21 is a bottom view of the control element of FIG. 19 according to an exemplary embodiment.

In one embodiment, upper member 180 is a generally annular or cylindrical member having a lower surface 181. Lower member 182 may be a generally hollow, tapered member that narrows from top (e.g., adjacent upper member 180) to bottom. The top of lower member 182 may be open and have an outer periphery that is spaced radially inward and apart from lower surface 181 of upper member 180, thereby forming outlet 169. As shown in FIG. 23, outlet 169 and apertures 170 are provided upstream from, or above, outlet 168. In some embodiments, outlets 168, 169 may be spaced apart by approximately one inch, while in other embodiments, outlets 168, 169 may be spaced apart by a greater or lesser distance. In yet further embodiments, outlets 168, 169 may be substantially aligned in the fluid flow path.

According to an exemplary embodiment, guide elements 172 are spaced about the periphery of lower member 182 and engage a bottom surface or portion (e.g., surface 181) of upper member 180. Adjacent guide elements 172 form corresponding channels 175 through which fluid exiting apertures 170 flows. In some embodiments, guide elements 172 may be substantially equally spaced about the periphery of lower member 182, while in other embodiments, guide elements 172 may be unequally spaced and/or unevenly distributed about the periphery of lower member 182 to provide a desired flow pattern. In one embodiment (shown in FIG. 21), twelve guide elements 172 are spaced about the periphery of lower member 182, while according to other embodiments, more or fewer guide elements 172 may be utilized to vary and/or provide a more even flow and/or spray pattern.

According to one embodiment, guide elements 172 extend along lower member 182 in a helical fashion, such that each individual guide element 172 follows a substantially helical path. As such, as fluid flows through apertures 170 and outlet portion 169, guide elements 172 and channels 175 direct the flow in a helical fashion along lower member 182 and impart a rotational flow to the fluid. The portion of flow that flows within lower member exits from control element 160 via outlet 168 in a substantially axial fashion.

In some embodiments, the helical pattern of each guide element 172 is at a relatively shallow angle relative to the longitudinal center axis of the shower head. This may result in reducing manufacturing costs such as injection molding control element 160. For example, control element 160 may be injection molded without any "slides" required during the molding process, which may reduce the potential for mismatch between parts and flash on critical surfaces of the control element. Further, substantial draft may be provided between the guide elements, permitting the part to be ejected out of a mold cavity following the helical curve of the guide elements after an injection molding or similar operation.

Figure 24:
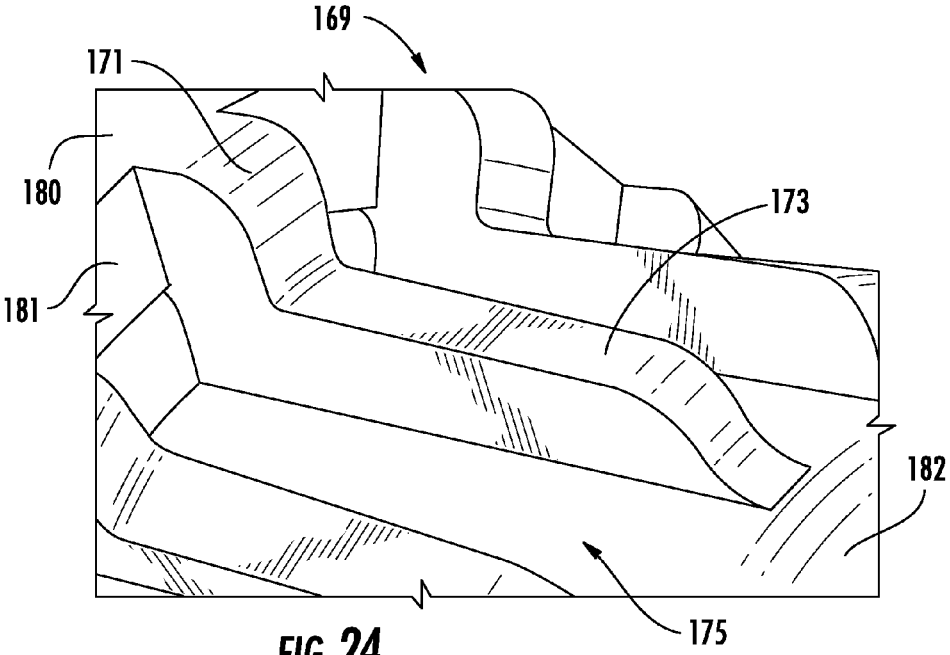
FIG. 24 is a perspective view of a portion of the control element of FIG. 19 according to an exemplary embodiment.
Figure 25:
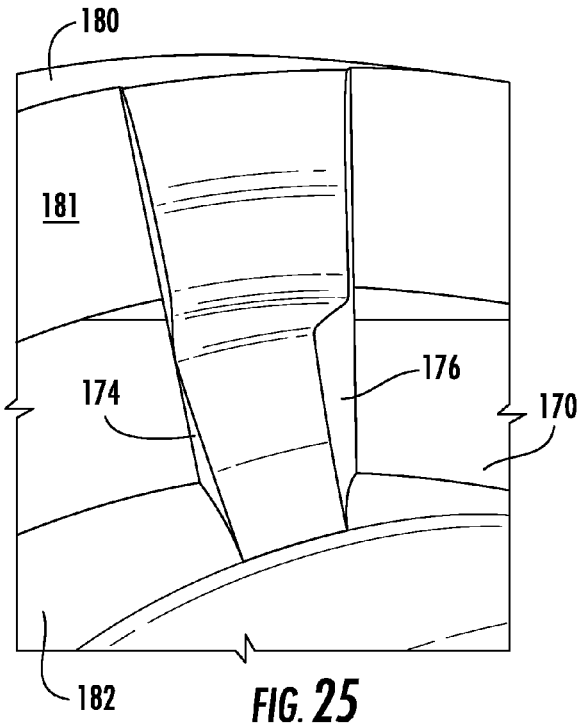
FIG. 25 is a perspective view of a portion of the control element of FIG. 19 according to an exemplary embodiment.
Figure 26:
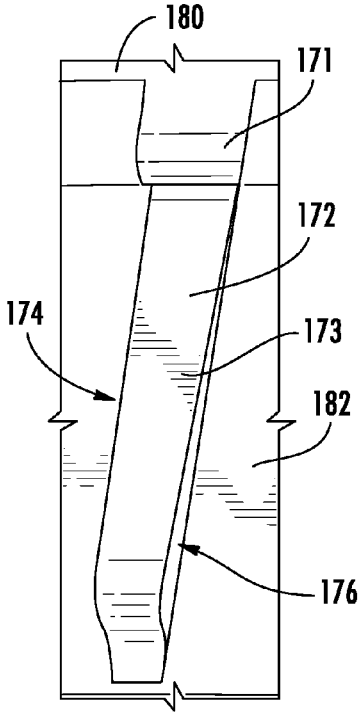
FIG. 26 is a perspective view of a portion of the control element of FIG. 19 according to an exemplary embodiment.

Referring now to FIGS. 24-26, an individual guide element 172 is shown in greater detail according to an exemplary embodiment. Guide element 172 includes an upper guide portion 171 and a lower guide portion 173. In some embodiments, upper portion 171 is a generally annular portion that extends across outlet 169 and is coupled to bottom surface 181 of upper member 180. Lower portion 173 is a substantially elongated member that extends longitudinally along at least a portion of the length of lower member 182. Guide elements 172 further include guide surfaces 174, 176 that, along with lower member 182, form channels 175. In some embodiments, each guide element 172 is generally "L"-shaped having a shorter leg extending across outlet 169 and a longer leg extending along the outer surface of lower member 182. In other embodiments the shape, size, and position of guide element(s) 172 may be varied to provide a desired flow pattern and/or volume.

In one embodiment, guide elements 172 extend from the top of lower member 182 and about one half of the way down the length of lower member 182. As such, channels 175 have sufficient length such that a rotation is imparted to substantially all of the fluid flowing through channels 175. In other embodiments, guide elements 172 may extend a farther or lesser distance along lower member 182. Furthermore, fluid flows between lower member 182 and main body 120 within bore 122. As the diameter of bore 122 decreases, the angular velocity of the rotational flow within guide elements 172 increases. As such, even with relatively shallow helical channels, sufficient rotation may be imparted to a portion of the flow.

According to an exemplary embodiment, due to the helical shape of guide elements 172, surfaces of 174 and 176 of guide elements 172 are curved surfaces, as best shown in FIGS. 25-26. In some embodiments, guide elements 172 are tapered to narrow from upper portion 171 and down through at least a portion of bottom portion 173. As such, the width of channels 175 may correspondingly increase in a "downstream" direction, from top to bottom of guide elements 172. Surfaces 174, 176 may form deflection surfaces that direct the otherwise annular flow into helical channels 175 and impart a rotation to the flow of fluid.

Figure 18:
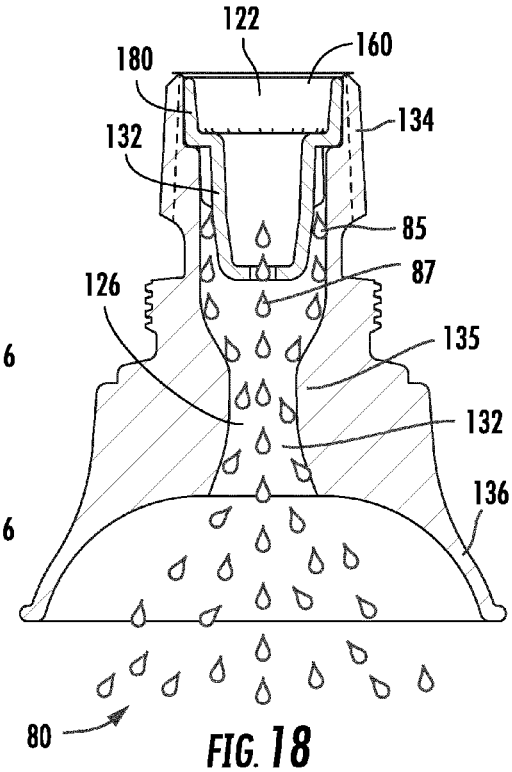
FIG. 18 is a cross-sectional view of the shower head of FIG. 15 taken along line 18-18 of FIG. 16 according to an exemplary embodiment.
Figure 22:
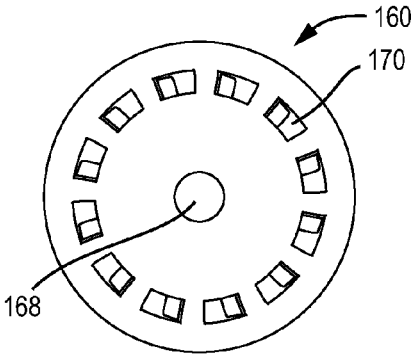
FIG. 22 is a top view of the control element of FIG. 19 according to an exemplary embodiment.
Figure 19:
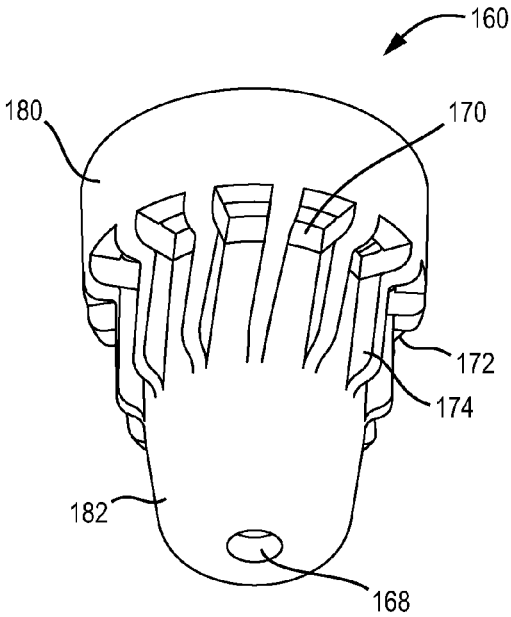
FIG. 19 is a perspective view of a fluid rotation control element of the shower head of FIG. 15 according to an exemplary embodiment.
Figure 20:
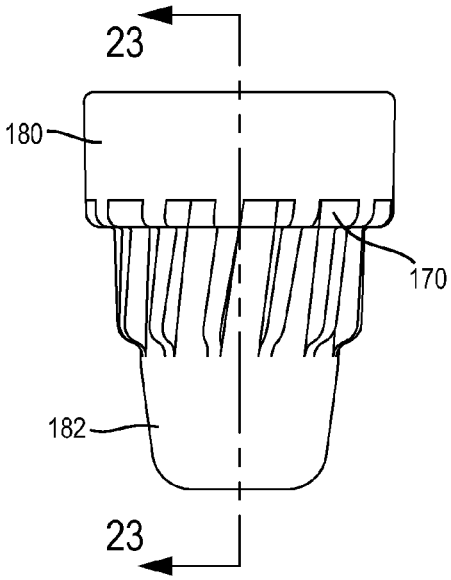
FIG. 20 is a side view of the control element of FIG. 19 according to an exemplary embodiment.

In operation, fluid enters showerhead 116 and control element 160 via inlet 162 (see FIG. 23). As shown in FIG. 18, a first portion 85 (see FIG. 18) of the fluid travels axially through upper member 180 of control element 160, exits upper outlet 169, and flows within channels 175 defined by guide elements 172. As fluid moves downstream within channels 175, a rotation is imparted to the first portion of the fluid flow. The fluid exiting from outlet 169 flows between lower member 182 of control element 160 and main body 120.

A second portion 87 (see FIG. 18) of the fluid flow entering control element 160 travels axially through upper member 180, continues to flow axially through lower member 182, and exits lower member 182 via lower outlet 168 in a substantially axial fashion. In one embodiment, lower outlet 168 defines a substantially straight bore, while in other embodiments, lower outlet 168 may be formed by a tapered bore that either narrows or widens in a downstream direction (e.g., top to bottom as shown in FIG. 23).

As shown in FIG. 18, the flow exiting from outlets 168, 169 passes through nozzle 126 of shower head 116, where the axial and rotational flows combine, and the combined flow exits via outlet 132, forming a desired spray pattern and/or providing a desired volume of fluid. It should be noted that in some embodiments, no separate drain holes are required. Rather, channels 175, along with the distance between apertures 168 and 169, provide sufficient drainage features to overcome any surface tension issues within the plumbing components and fully drain the system back to an appropriate shut off valve.

While guide elements 172 are shown in FIGS. 24-26 as having a generally helical configuration, according to various alternative embodiments, guide elements may be configured to provide generally straight-sided channels 175 (e.g., non-helical and/or non-tapering channels) that impart rotation to fluid exiting from outlet 169. Other configurations may be utilized according to various other embodiments. For example, in some embodiments, guide elements may be angled, linear members that impart a rotation onto a portion of flow.

Figure 15:
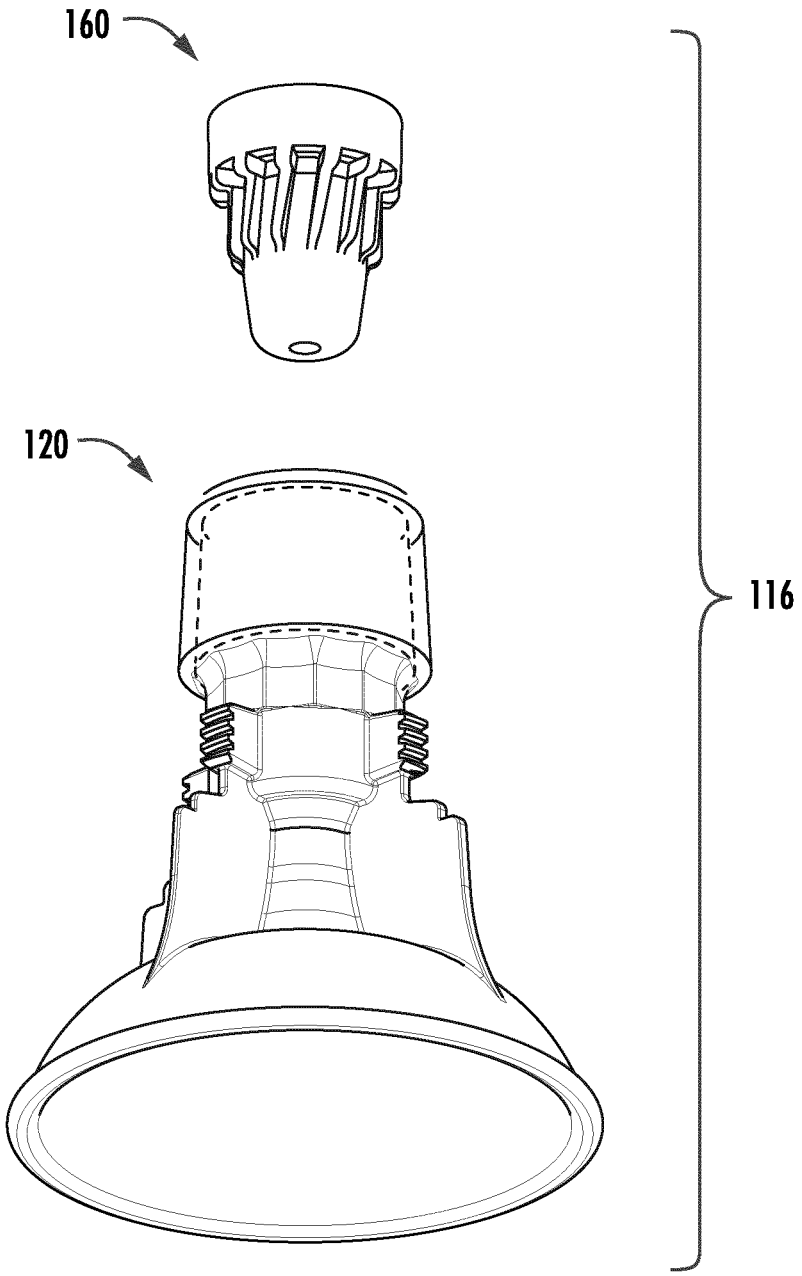
FIG. 15 is an exploded view of a shower head according to an exemplary embodiment.
Figure 17:
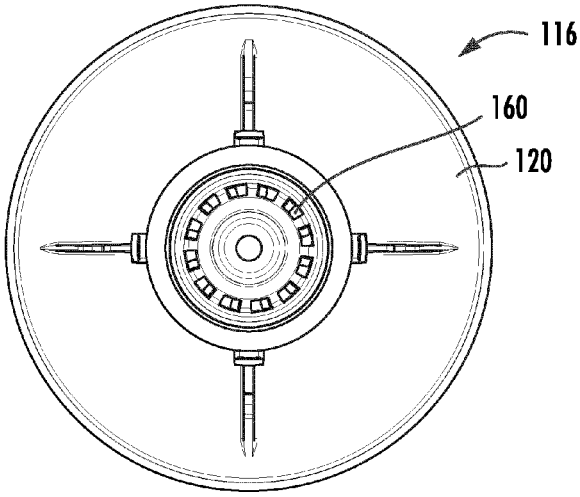
FIG. 17 is a top view of the shower head of FIG. 15 according to an exemplary embodiment.
Figure 16:
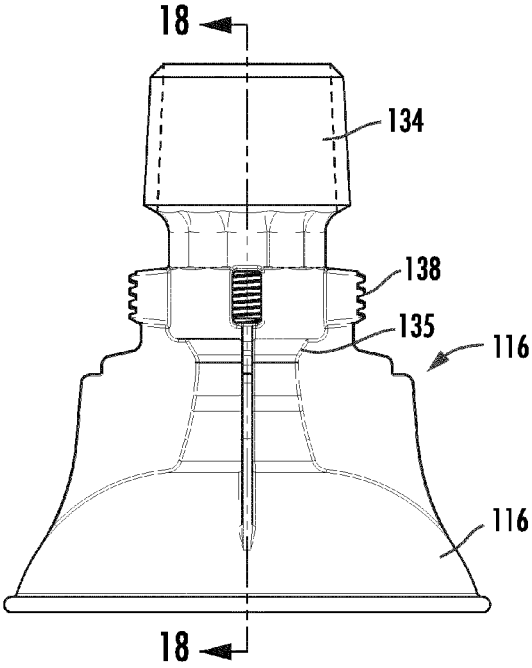
FIG. 16 is a side view of the shower head of FIG. 15 according to an exemplary embodiment.

Various embodiments, including those described in connection with FIGS. 15-26, may provide benefits over conventional fixtures and showerheads. The showerheads disclosed herein may be configured to meet various applicable standards (e.g., ANSI Z358.1 and/or EN 15154). Further, in certain embodiments, fewer parts are required (e.g., a main body and a rotation control element as shown in FIG. 15) and the showerhead may have no moving parts as some embodiments are implemented without the user of a separate flow regulator. A simplified design may reduce manufacturing costs and improve consistency and/or reliability.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Such joining may also relate to mechanical, fluid, or electrical relationship between the two components.

It is also important to note that the construction and arrangement of the elements of the showerhead as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. An apparatus for controlling a flow of fluid in an emergency fixture, the apparatus comprising:

a body;

a control element disposed at least partially within the body; the control element comprising:

a first body configured to provide an axial flow to a first portion of fluid;

a second body coupled to the first body via a plurality of flow guide elements, each flow guide element extending along an exterior surface of the first body in a substantially helical fashion and configured to impart a rotation to a second portion of fluid;

wherein each of the plurality of flow guide elements defines a generally L-shaped deflection surface defined by a relatively shorter leg of each flow guide element extending transversely between the first and second bodies and a relatively longer leg of each flow guide element extending generally along the length of the first body.

2. The apparatus of claim 1, wherein the second portion of fluid flows to the exterior of the first body.

3. The apparatus of claim 1, wherein the plurality of flow guide elements are substantially evenly spaced about the exterior of the first body.

4. The apparatus of claim 1, wherein each of the flow guide elements is tapered along the length of the first body.

5. The apparatus of claim 1, wherein the first portion of fluid exits the first body downstream from where the second portion of fluid exits the second body.

6. An apparatus for controlling a flow of fluid, the apparatus comprising:

a body;

a control element located at least partially within the body and configured to impart a rotation to the flow of fluid, the control element comprising:

an upper member; and a lower member positioned downstream from the upper member and coupled to the upper member via a plurality of flow control elements, each flow control element comprising a curved deflection surface;

wherein the lower member is configured to receive a first portion of the fluid from the upper member and direct the first portion of the fluid out a first outlet in an axial flow manner; and wherein the plurality of flow control elements are configured to receive a second portion of the fluid from the upper member via a second outlet and impart a rotation to the second portion of the fluid as the second portion of the fluid flows between the lower member and the body.

7. The apparatus of claim 6, wherein the plurality of flow control elements form channels extending along the exterior of the lower member.

8. The apparatus of claim 6, wherein the plurality of flow control elements extend along the exterior of the lower member in a helical fashion.

9. The apparatus of claim 6, wherein the plurality of flow control elements are substantially evenly spaced about the periphery of the lower member.

10. The apparatus of claim 6, wherein the first outlet is positioned downstream from the second outlet.

11. The apparatus of claim 6, wherein the lower member is tapered such that the exterior of the lower member narrows in a direction away from the upper member.

12. A fixture for delivering a flow of fluid, the fixture comprising:

a valve;

a shower head coupled to the valve and comprising a body and a flow control element, the flow control element comprising:

an upper generally tubular member;

a lower tapered member provided downstream from the upper member and coupled to the upper member via a plurality of flow directing elements; each flow directing element comprising:

an upper portion extending between the upper member and the lower member; and an elongated lower portion extending in a downstream direction from the upper portion and along the outside surface of the lower member, the elongated lower portion having at least one curved surface.

13. The fixture of claim 12, wherein the plurality of flow directing elements extend in a helical fashion along the lower member.

14. The fixture of claim 12, wherein the upper member comprises an annular bottom surface, and wherein the upper portion of each flow directing element is coupled to the bottom surface.

15. The fixture of claim 12, wherein the upper and lower portions of each flow directing element form an L-shape.

* * * * *